United States Patent [19]

Achelpohl et al.

[11] Patent Number: 4,657,528

[45] Date of Patent: Apr. 14, 1987

[54] APPARATUS FOR STACKING AND CONVEYING FLAT ARTICLES, PREFERABLY BAGS MADE OF PLASTIC FILM

[75] Inventors: Fritz Achelpohl; Friedhelm Mundus, both of Lengerich; Werner Krutemeier, Löhne, all of Fed. Rep. of Germany

[73] Assignee: Windmoller & Holscher, Lengerich, Fed. Rep. of Germany

[21] Appl. No.: 800,810

[22] Filed: Nov. 22, 1985

[30] Foreign Application Priority Data

Nov. 23, 1984 [DE] Fed. Rep. of Germany ..... 3442851
Feb. 20, 1985 [DE] Fed. Rep. of Germany ..... 3405858

[51] Int. Cl.[4] ..... B31B 41/02
[52] U.S. Cl. ..... 493/204; 493/926
[58] Field of Search ..... 493/189, 194, 204, 186, 493/480, 226, 227

[56] References Cited

U.S. PATENT DOCUMENTS

| | | | |
|---|---|---|---|
| 3,548,723 | 12/1970 | Sengewald | 493/226 |
| 3,803,990 | 4/1974 | Pedersen | 493/227 |
| 4,181,069 | 1/1980 | Porter | 493/204 |
| 4,371,365 | 2/1983 | Shingo | 493/25 |
| 4,451,249 | 5/1984 | DeBin | 493/204 |
| 4,549,877 | 10/1985 | Lehmacher | 493/204 |

FOREIGN PATENT DOCUMENTS

| | | | |
|---|---|---|---|
| 2521482 | 8/1983 | France | 493/227 |

*Primary Examiner*—Frederick R. Schmidt
*Assistant Examiner*—William E. Terrell
*Attorney, Agent, or Firm*—Fleit, Jacobson, Cohn & Price

[57] ABSTRACT

Apparatus for stacking and conveying flat articles that are preferably provided with locating holes and preferably consist of bags that have been severed from a tubular or semitubular plastic film web and have been closed by welding. The bags are carried from a forming station to a pair of adjacent, parallel stacking conveyors by a rotatable wicketer having spaced pairs of radial transfer arms. The stacking conveyors include endless belt like carries that pass around rotatable wheels or rollers and are intermittently driven. The carriers include upstanding stacking pins or stacking needles, which extend from and are secured to carrying plates mounted on the carriers. Two spaced, adjacent stacking conveyors are provided and different tools for acting on the intermittently conveyed stacks of bags are selectively provided and detachably secured to the frame of the apparatus between the stacking conveyors. The stacking conveyors and tools are movable transversely relative to the conveying direction to adjust the positions of the tools relative to the bags.

10 Claims, 5 Drawing Figures

APPARATUS FOR STACKING AND CONVEYING FLAT ARTICLES, PREFERABLY BAGS MADE OF PLASTIC FILM

BACKGROUND OF THE INVENTION

1. Field of the Invention

This invention relates to apparatus for stacking and conveying flat articles, and more particularly to apparatus for stacking and conveying flat articles in the from of bags, with or without locating holes therein, and which have been severed from a tubular or semitubular plastic film web for collection into stacks.

2. Description of the Prior Art

Apparatus for stacking and conveying plastic bags is disclosed in German Pat. No. 31 38 221. In the operation of that known apparatus, double bags which have been severed from a tubular film web and have been provided with a seam weld are deposited on stacking plates, which are carried by a single conveyor that is provided on opposite sides of its longitudinal centerline with a series of stacking pins for retaining the bags. The bags are separated from each other by means of a heated knife, which is adapted to be raised and lowered and cuts through the stacks at a cutting station between the rows of stacking pins. Because the stacking plates of the conveyor also constitute the abutments for cooperation with the heated knives, the stacking plates must be relatively large and heavy to withstand the loads imposed during the cutting operation.

It is an object of the present invention to overcome the problems that result from use of the prior art apparatus and to provide plastic bag cutting apparatus that is readily adaptable to different bag sizes and changing conditions, and that permits the stacks of bags to be acted upon differently and in a simple manner.

SUMMARY OF THE INVENTION

Briefly stated, in accordance with one aspect of the present invention, apparatus for stacking and conveying flat articles is provided to receive articles that can include locating holes and can be in form of plastic bags that have been severed from a tubular or semitubular plastic film web and have been closed by welding. The articles are transferred from a bag severing and sealing station to a conveyor by a rotatable wicketer supported in a wicketer frame and having laterally spaced pairs of transfer arms that carry the severed and sealed bags. The apparatus includes a frame, and a pair of laterally spaced, intermittently movable parallel stacking conveyors for receiving the bags from the wicketer and for conveying the bags in a conveying direction away from the wicketer. The stacking conveyors each include bag supporting means for supporting and carrying the bags, and stacking pin means extending upwardly from the bag supporting means for retaining a plurality of bags in stacked relationship on the bag supporting means. Bag cutting means are positioned between the stacking conveyors for performing a cutting operation on a stack of bags, the bag cutting means being spaced laterally from and being independent of the bag supporting means and including a fixed element and a movable element, each of which is carried by the frame and is cooperable with each other for performing a cutting operation on the stack of bags.

DESCRIPTION OF THE PREFERRED EMBODIMENTS

Two illustrative embodiments of the invention will now be described with reference to the drawings.

Figure 1A:
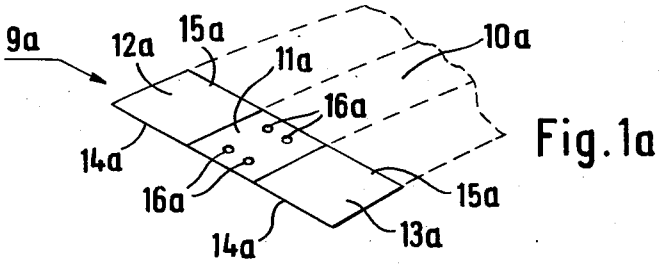
FIG. 1*a* is a fragmentary perspective view of a web and a double bag that can be carried and severed using apparatus in accordance with the present invention.
Figure 1:
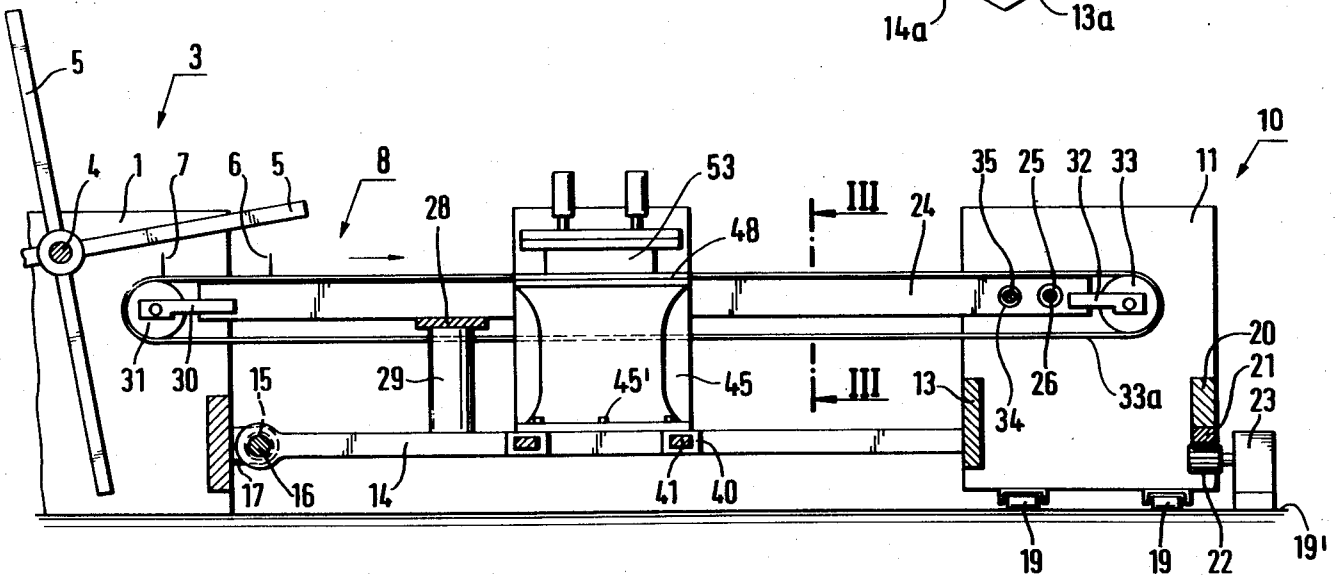
FIG. 1 is a fragmentary side elevational view, partially in section, showing a bag stacking and severing apparatus in accordance with the present invention and showing the structure as viewed along the line I—I of FIG. 2.
Figure 2:
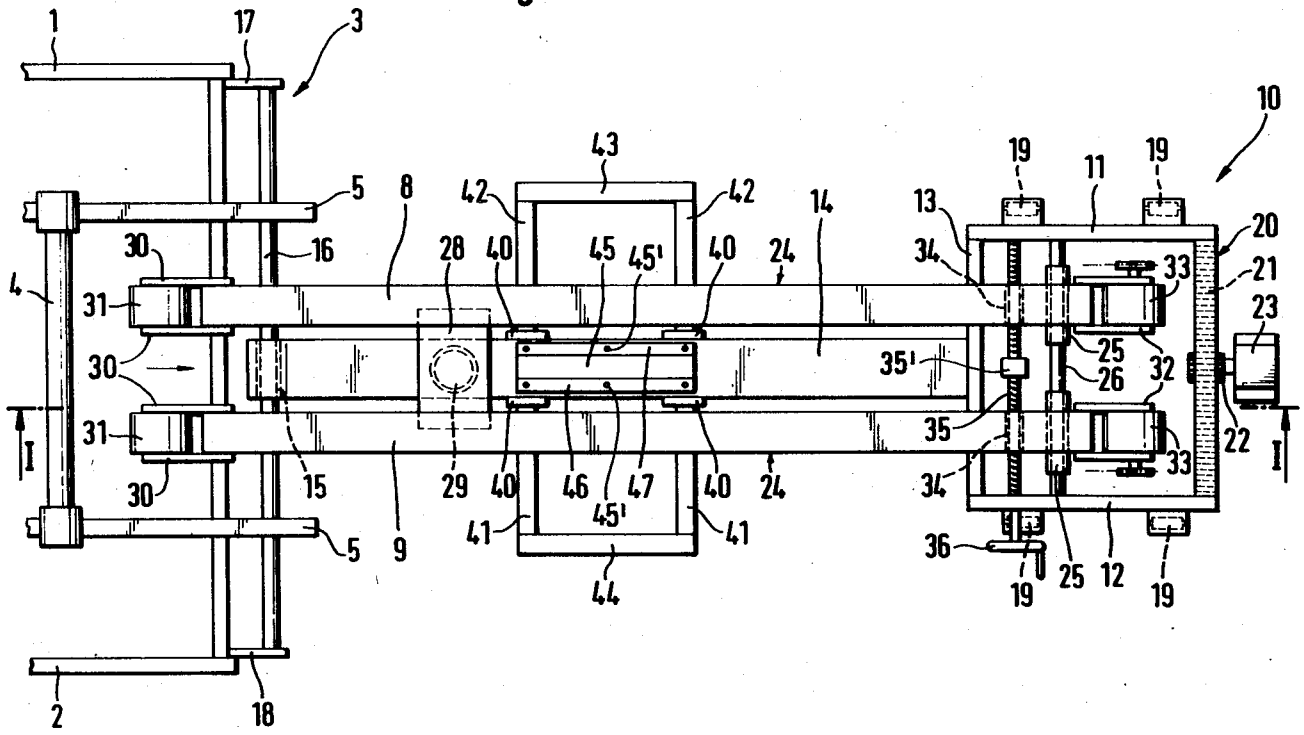
FIG. 2 is a plan view showing the stacking and severing apparatus of FIG. 1.

Referring to FIGS. 1 and 2 of the drawings, wicketer frame 3 includes a pair of laterally spaced side panels 1, 2, in which a transversely extending shaft 4 is rotatably mounted. The shaft 4 can be rotated by suitable drive means (not shown), such as a stepping motor, or the like, and carries laterally spaced pairs of radially extending transfer arms 5, which are provided with vacuum cups or other suitable gripping means for gripping plastic bags or the like. The wicketer frame 3 is adjacent and downstream of a transverse severing and welding apparatus (not shown) that serves to sever bags from a tubular or semitubular plastic film web and to close the resulting bags by welding. The welded bags, which can be in the form of single bags or double bags, are individually taken from the severing and welding apparatus by respective pairs of transfer arms 5, which are carried through an arc of about 180°, by virtue of rotation of shaft 4, to deposit the bags on the stacking pins 6, 7 of respective parallel stacking conveyor lines 8, 9 that are positioned immediately downstream of wicketer frame 3. As soon as a stack of a predetermined number of bags has been formed on a set of stacking pins, stacking conveyor lines 8, 9, which include belts that carry the respective stacking pins, are incrementally advanced in the conveying direction shown by the arrow in FIG. 1 for a predetermined distance so that a different set of stacking pins is positioned for receiving the bags from the transfer arms to form another, separate stack of bags.

One form of bag that can be used with the present invention is shown in FIG. 1*a*. The bag structure 9a is severed from a continuous web 10*a* to provide a double bag including bag portions 12*a* and 13*a*, which are spaced transversely across from each other along adjacent side edges of the web. Each of bag portions 12*a* and 13*a* have been sealed along respective marginal edges 14*a* and 15*a* to provide a bag having three closed edges and one unsealed edge that defines an opening. An intermediate portion 11*a* extends between the respective bag portions 12*a* and 13*a*, and can include a plurality of suitably spaced locating holes 16*a* for positioning the bag on the stacking conveyors.

An end frame 10 supports the downstream ends of stacking conveyors 8 and 9, and includes laterally spaced side plates 11, 12 that are interconnected by a forward crossbeam 13. A longitudinal beam 14 is positioned below and along the conveying direction of stacking conveyors 8 and 9 and is rigidly connected to the crossbeam 13. Beam 14 extends longitudinally of the apparatus to wicketer frame 3 and is transversely slidably connected thereto by means of bushing 15 secured to beam 4. Bushing 15 is slidably carried on a transverse shaft 16 that is supported by longitudinally extending brackets 17, 18 that are secured to side panels 1, 2 respectively, of the wicketer frame 3.

Adjacent to and below each of side panels 11, 12, the end frame 10 is provided with two pairs of parallel, aligned rollers 19, which are rotatably carried by the end frame and are guided in transversely extending tracks (not shown) secured to the floor 19'. The rearmost portions of the side members 11, 12 of the end frame 10 are rigidly connected by a crossbeam 20, which carries on its underside a transversely extending rack 21. A pinion 22 is in meshing engagement with rack 21 and is rotatable by means of a gearbox and motor 23, which is secured to the floor 19'. The gearbox and motor 23 is operable to move end frame 10 along the tracks by means of rollers 19 in a transverse direction relative to the conveying direction. Because of the rigid connection between beam 14 and end frame 10, beam 14 moves transversely therewith and the bushing 15 at the forward end of beam 14 is is slidably moved along transverse shaft 16. Thus the lateral position of stacking conveyors 8, 9 relative to wicketer frame 3 can readily be varied and adjusted as desired.

Stacking conveyors 8 and 9 are laterally spaced from each other and include respective longitudinal beams 24 that carry transversely extending bushings 25 at their downstream ends adjacent end frame 10. Bushings 25 are slidably guided on a transverse shaft 26, which is in the form of a tube or the like, and is secured to side panels 11, 12. In the forward one-third of their lengths, closer to wicketer frame 3 than to end frame 10, each of longitudinal beams 24 of stacking conveyors 8 and 9 is supported on a low-friction, horizontal support plate 28, which is carried by a ram 29 secured to and extending upwardly from longitudinal beam 14. Longitudinal beams 24 of each of stacking conveyors 8 and 9 have a bifurcated forward end portion including a pair of transversely spaced legs 30 that carry a fixed, transversely extending shaft to freely rotatably carry conveyor support wheels 31. The rearward portions of each of beams 24 adjacent end frame 10 are also bifurcated and include transversely spaced legs 32 that carry a fixed transversely extending shaft to rotatably carry conveyor support wheels 33. Endless conveyor belts 33*a*, which can be cogged rubber belts, or chains, pass over support wheels 31, 33 to carry the bags along stacking conveyors 8, 9 in the conveying direction. The wheels 33 are each connected to suitable drive means (not shown) to cause the conveyor belts to move in the conveying direction.

Longitudinal beams 24 of each of stacking conveyors 8, 9 each carry a transversely extending, internally threaded sleeve 34 that is non-rotatably secured thereto adjacent the ends of the beams that are received in end frame 10, with the respective threads in each sleeve 34 being of opposite hand relative to the other. Both of sleeves 34 are in threaded engagement with a transversely extending, common screw 35, which includes a center stop 35' and which has external screw threads of opposite hand on opposite sides of stop 35' associated with and for engagement with the internal threads in respective ones of the sleeves 34. Screw 35 is rotatably carried in side panels 11, 12 of end frame 10 and one end portion of the screw 35 extends through the side member 12 and is provided with a handwheel 36, which is operable to manually turn shaft 35 and thereby cause longitudinal beams 24 to simultaneously move toward or away from each other to adjust the lateral spacing between the stacking conveyors 8 and 9 in order to accommodate bags of different sizes. During adjustment of that lateral spacing, the beams 24 of the two stacking conveyors slide on the support plate 28, the uppermost surface of which is preferably polished to a smooth, low friction surface, or is provided with a low-friction coating, such as, for example, Teflon, or the like.

As best seen in FIG. 2, lower longitudinal beam 14 connects the wicketer frame 3 to the end frame 10 and includes laterally extending base frame members 41, 42, that extend outwardly therefrom and that are connected to the longitudinal beam 14 by flanges 40. The base frame members 41, 42 carry longitudinally extending side frame members 43, 44, which are interconnected with members 41, 42, respectively, and are disposed laterally outwardly of the stacking conveyors 8, 9 and provide supports outwardly of the stacking conveyors to carry tools for processing the stacks of bags carried thereby, as will hereinafter be explained.

Figure 3:
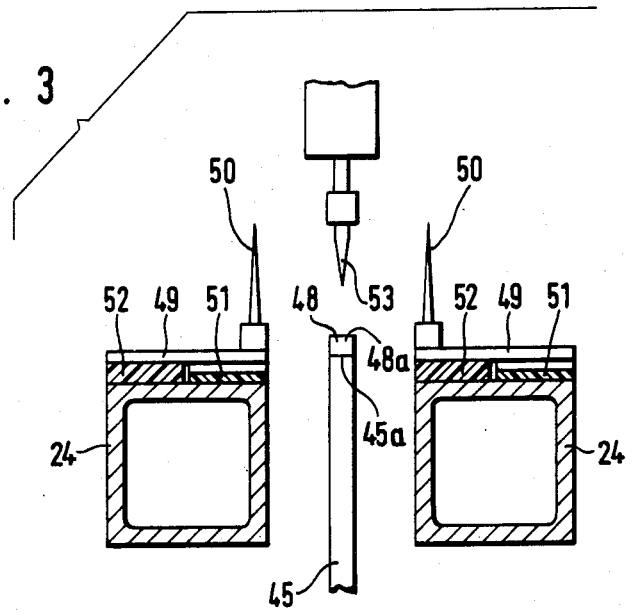
FIG. 3 is a fragmentary transverse sectional view taken along the line III—III of FIG. 1 and showing the stacking and severing apparatus provided with a cutting knife and with an abutment that is fixed to the frame, the knife and abutment serving as processing tools.

In the embodiment shown in FIGS. 1 to 3, an abutment 45 is screw-connected to the lower longitudinal beam 14 and extends upwardly therefrom into the space between longitudinal beams 24 of respective stacking conveyors 8 and 9. Abutment 45 is a generally plate-like member and is provided at its lowermost longitudinal edges with flanges 46, 47, which receive connecting screws 45' for connection to beam 14. The abutment 45 is cushioned at its upwardly facing end surface 45*a* by a sufficiently heat-resistant plastic backup bar 48, the upwardly facing surface 48a of which is disposed adjacent to and between the planes of travel of the stacking pins 50, which are supported at the innermost ends of individual carrier plates 49. The carrier plates 49 which carry the stacking pins 50 are connected alternately to one or the other of laterally adjacent, parallel cogged belts 51, 52, which are provided in pairs on each side of abutment 45.

A heated cutting knife 53 is carried by supports (not shown) that extend upwardly and inwardly from side frame members 43, 44 to extend above and between stacking conveyors 8 and 9. Knife 53 is adapted to be raised and lowered relative to plastic backup bar 48 to cooperate therewith to sever the portion of the stacks of bags that extend across stacking conveyors 8 and 9 and along a line extending between the stacking pins 50 on respective stacking conveyors 8 and 9.

Figure 4:
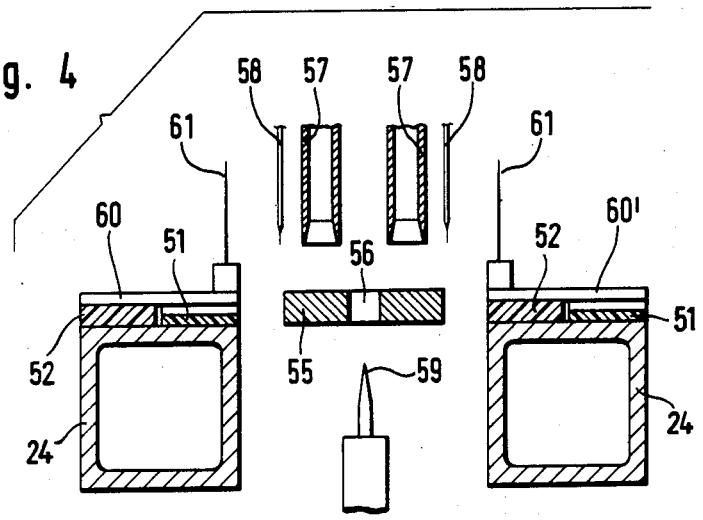
FIG. 4 is a fragmentary sectional view similar to FIG. 3 and showing the stacking and severing apparatus of FIG. 1 adjacent to the processing tools and with a different set of tools.

In a further illustrative embodiment shown in FIG. 4, an abutment plate 55 is suitably secured to and supported by beam 14 and includes a longitudinally extending, elongated central opening 56. Abutment plate 55 extends transversely between and is spaced from the stacking conveyors carried by respective longitudinal beams 24, and also extends in the conveying direction for a distance substantially equal to the longitudinal dimension of a stack of bags in the conveying direction. A pair of vertically movable retaining rams 57 and a pair of vertically movable perforating knives 58 are carried by supports (not shown) that extend upwardly and inwardly from side frame members 43, 44 and are disposed above abutment plate 55 for movement toward and away therefrom. A heatable cutting knife 59 is carried on beam 14 between the stacking conveyors and is movably disposed under abutment plate 55 so that it can be raised and lowered relative thereto and to pass into and through opening 56 when in a fully raised condition. When the retaining rams 57 have been lowered, the intermediate portion of the stacking bags is securedly clamped between rams 57 and abutment 55, and knife 59 is raised to pass through opening 52 and cut through the stack, which extends across abutment plate 55 and the adjacent stacking conveyors. The stacks can be simultaneously perforated by perforating knives 58.

In the embodiment shown in FIG. 4, thin needles 61 are secured to plates 60, which, in turn, are secured to alternate ones of the cogged belts 51, 52. Needles 61 extend upwardly from plates 60 and pierce the respective bags as they are transferred by the transfer arms 5 to the stacking conveyors 8, 9, and eliminate the need for a previous formation of locating holes in the bags. If each plate 60 is provided with only one needle 61 eccentrically disposed thereon, relative to the laterally extending centerline of the bags, the stack section held by each of the needles will pivot relative to needle 61 when the stack has been cut through by means of the heated cutting knife 59 and retaining rams 57 have been raised to release the clamping force, resulting in two separate stacks. By that pivoting movement the cut edges of the bags will be moved away from the cutting knife 59.

In view of the provision of two spaced stacking conveyor lines, it can be seen that various processing tools can be selectively provided between the stacking lines and secured to the frame of the apparatus, and can cooperate in any desired manner because it is no longer necessary to use the intermittently moving stacking plate as a backing tool. For this reason, the stacking conveyor lines can be lighter in weight because they need only carry the stacks of bags, and do not need to serve as backing tools. Further, the tools can be any of various designs of cutting or perforating knives, as hereinbefore described, or they can also be in the form of punches for punching grip openings in the bags to form a handle for conveniently carrying the respective bags after the two side-by-side bags have been severed from each other.

In addition to the operation of the apparatus as hereinabove described, the ability to move the stacking conveyors transversely relative to the wicketer permits the formation of stacks of bags on only one of the stacking conveyors, if desired, and to effect that operation the two stacking lines can be simultaneously transversely moved adjacent so that the transfer arms on one side of the wicketer are disposed between the stacking lines. With such an arrangement, it is not necessary to remove the tools from between the stacking conveyors because they will not interfere with the stacking operation.

Although particular embodiments of the present invention have been illustrated and described, it will be apparent to those skilled in the art that various changes and modifications can be made without departing from the spirit of the present invention, and it is intended to cover in the appended claims all such changes and modifications that fall within the scope of the present invention.

What is claimed is:

1. Apparatus for stacking and conveying flat articles in the form of flat tubular plastic bags that have been produced from a flat tubular or semitubular plastic film web and severed and sealed at a bag severing and sealing station, which apparatus comprises:

(a) a frame;

(b) a conveying means;

(c) means for transferring the flat tubular plastic bags from the severing and sealing station to said conveying means in stacked relationship, comprising a wicketer rotatably carried in said frame, said wicketer including a plurality of laterally spaced pairs of transfer arms for carrying the bags;

(d) said conveying means being positioned downstream of said wicketer, said conveying means including a pair of laterally spaced, parallel stacking conveyors for receiving the bags from said wicketer and for intermittently conveying the received bags in a conveying direction away from the wicketer;

(e) said stacking conveyors each including bag supporting means for supporting and carrying the bags, and stacking pin means extending upwardly from said bag supporting means for retaining a plurality of the bags in stacked relationship on said bag supporting means; and (f) bag cutting means positioned between said stacking conveyors for performing a cutting operation on the stack of bags, said bag cutting means being spaced laterally from and being independent of said bag supporting means and including a fixed element and a movable element each carried by said frame and cooperable with each other for performing the cutting operation on the stack of bags.

2. Apparatus according to claim 1, wherein said bag cutting means includes a fixed abutment defining said fixed element and secured to said frame and positioned adjacent to a plane of conveyance of the bags, said abutment having a length substantially equal to the longitudinal dimension of stacks of bags in their direction of travel, and said movable element including a cutting knife, movable toward and away from said abutment.

3. Apparatus according to claim 1, wherein said bag cutting means includes a fixed abutment defining said fixed element secured to said frame and positioned adjacent to a plane of conveyance of the bags, said abutment having a length substantially equal to the longitudinal dimension of stacks of bags in their direction of travel, and said movable element includes a cutting knife, movable toward and away from said abutment and having substantially the same length as said abutment, and said movable element includes retaining means movable into and out of contact with a stack of bags carried on said abutment plate for retaining a stack of bags in position against said abutment plate.

4. Apparatus according to claim 3, wherein said abutment plate includes an opening for permitting a cutting knife to move therethrough, said cutting knife positioned below the plane of conveyance of the bags to cut a stack of bags from below.

5. Apparatus according to claim 1, wherein said stacking pin means includes unitary pins carried by said bag supporting means and a single stack of bags is supported on two pins, one carried by each of said stacking conveyors to hold a stack of bags in position, each of said pins being offset from a transverse centerline of the stack of bags supported thereby.

6. Apparatus according to claim 1, wherein said stacking conveyors each include a conveyor end frame and a longitudinal conveyor beam supported between the wicketer and mounted on a horizontal transverse shaft rotatably carried in said end frame and for rotation about the axis of said shaft, a longitudinal support beam extending from the end frame to the wicketer frame and rigidly connected to the end frame, said support beam having a foward end that is mounted on and displaceable along a stationary transverse shaft carried by the wicketer frame, and support means carried by said support beam between said end frame and the wicketer frame for supporting said conveyor beams, said end frame movably supported in contact with transversely extending tracks secured to a floor so that said end frame is displaceable along said tracks, and means secured to the floor for moving said end frame in a transverse direction along said tracks.

7. Apparatus according to claim 6, wherein said end frame is supported by and is transversely movable on rollers.

8. Apparatus according to claim 6, wherein said end frame includes a crossbeam and said crossbeam includes a rack, a pinion in mesh with said rack, and drive means secured to the floor for rotating said pinion to cause transverse movement of said end frame.

9. Apparatus according to claim 6, wherein said longitudinal conveyor beams include bushing means at each end thereof, said bushing means at the end of said beams adjacent said end frame slidably carried on said transverse shaft of said end frame, and said longitudinal conveyor beams include internally threaded sleeves adjacent said end frame and spaced longitudinally from said bushing means, respective ones of said sleeves having threads of opposite hand in threaded engagement with an externally threaded transversely extending common screw rotatably carried in said end frame and having threads of opposite hand in engagement with said threads in respective ones of said sleeves, said screw being rotatable to adjust the lateral spacing of said stacking conveyors, and said support means includes a support plate for slidably supporting said longitudinal beams for lateral movement relative to said conveying direction.

10. Apparatus according to claim 3, wherein said bag cutting means includes second cutting means for cutting openings in the stack of bags.

* * * * *